United States Patent [19]

Tajima et al.

[11] 4,319,451

[45] Mar. 16, 1982

[54] METHOD FOR PREVENTING OVERHEATING OF AN EXHAUST PURIFYING DEVICE

[75] Inventors: Masahiko Tajima, Takahama; Yasuo Sagisaka, Kariya; Toshio Kondo, Anjo; Akio Kobayashi, Kariya, all of Japan

[73] Assignee: Nippondenso Co., Ltd., Kariya, Japan

[21] Appl. No.: 131,765

[22] Filed: Mar. 19, 1980

[30] Foreign Application Priority Data

Apr. 4, 1979 [JP] Japan ..... 54-40732

[51] Int. Cl.[3] ..... F01N 3/20; F02B 75/10

[52] U.S. Cl. ..... 60/274; 60/277; 60/285; 123/440; 123/480; 123/486; 123/489

[58] Field of Search ..... 60/277, 285, 274; 123/486, 440, 480, 489

[56] References Cited

U.S. PATENT DOCUMENTS

| | | | |
|---|---|---|---|
| 4,051,672 | 10/1977 | Masaki | 60/277 |
| 4,200,064 | 5/1980 | Engele | 123/440 |
| 4,231,220 | 11/1980 | Takeda | 60/277 |
| 4,274,141 | 6/1981 | Tokuda | 123/486 |

*Primary Examiner*—Douglas Hart

*Attorney, Agent, or Firm*—Cushman, Darby & Cushman

[57] ABSTRACT

A method for preventing overheating of an exhaust purifying device by means of an air-flow sensor for sensing the amount of air drawn into an engine to generate an analog voltage corresponding to the amount of air drawn, an intake-air temperature sensor for sensing the temperature of the air drawn into the engine to generate an analog voltage corresponding to the temperature of the air drawn, a water temperature sensor for sensing the temperature of the engine cooling water temperature to generate an analog voltage corresponding to the cooling water temperature, a temperature sensor mounted on a converter, an RPM sensor for sensing the rotational speed of the engine to generating a pulse signal of a frequency corresponding to the engine speed, and a circuit responsive to the detection signals from the sensors for computing the desired amount of fuel injected. The computing circuit controls the ON and OFF periods of fuel injection valves to adjust the fuel injection quantity. When the exhaust temperature exceeds a predetermined value, the air-fuel ratio is compensated for the then current engine operating conditions and the compensation amount is then stored in a memory, whereby each time the same engine operating conditions are repeated, the air-fuel ratio is compensated in accordance with the stored compensation data to thereby prevent overheating of the exhaust purifying device.

2 Claims, 5 Drawing Figures

| Q \ N | 1 | 2 | 3 | --- | n-2 | n-1 | n | n+1 | n+2 | --- |
|---|---|---|---|---|---|---|---|---|---|---|
| 1 | $K_2(1,1)$ | $K_2(2,1)$ | $K_2(3,1)$ | | | | | | | |
| 2 | $K_2(1,2)$ | $K_2(2,2)$ | $K_2(3,2)$ | | | | | | | |
| 3 | $K_2(1,3)$ | $K_2(2,3)$ | $K_2(3,3)$ | | | | | | | |
| ⋮ | | | | | | | | | | |
| m-1 | | | | | $K_2(n-2,m-1)$ | $K_2(n-1,m-1)$ | $K_2(n,m-1)$ | $K_2(n+1,m-1)$ | $K_2(n+2,m-1)$ | |
| m | | | | | $K_2(n-2,m)$ | $K_2(n-1,m)$ | $K_2(n,m)$ | $K_2(n+1,m)$ | $K_2(n+2,m)$ | |
| m+1 | | | | | $K_2(n-2,m+1)$ | $K_2(n-1,m+1)$ | $K_2(n,m+1)$ | $K_2(n+1,m+1)$ | $K_2(n+2,m+1)$ | |
| ⋮ | | | | | | | | | | |

METHOD FOR PREVENTING OVERHEATING OF AN EXHAUST PURIFYING DEVICE

BACKGROUND OF THE INVENTION

1. Field of the Invention

This invention relates to an overheating preventing method for exhaust purifying devices, whereby the temperature of an internal combustion engine exhaust purifying device such as a catalytic converter is prevented from increasing excessively by adjusting the air-fuel ratio of the exhaust gases.

2. Description of the Prior Art

With known internal combustion engines, it has been the usual practice so that a range of air-fuel ratios at which the temperature of a catalytic converter rises is determined by experiments and the air-fuel ratios in the thus determined range are preset to the rich side to thereby prevent the temperature of the catalytic converter from becoming so high. However, this known construction is disadvantageous in that since a range of enriched air-fuel ratios is predetermined, this range must be selected large enough in consideration of the variations in performance caused by different engines and the increased range tends to result in deteriorated fuel consumption, increased exhaust emissions, etc.

SUMMARY OF THE INVENTION

With a view to overcoming the foregoing deficiencies in the prior art, it is the object of the present invention to provide a method for preventing overheating of an exhaust purifying device in which the respective engine operating conditions are associated with various temperatures of an exhaust purifying device or various temperatures in the exhaust system, whereby when the exhaust system temperature exceeds a predetermined value (or becomes overheated), the air-fuel ratio associated with the corresponding operating condition is corrected (adjusted) so that the corrected value (data) is stored in the memory and each time this operating condition is repeated the operation of correcting the air-fuel ratio in accordance with the stored corrected value or data and simultaneously further adjusting the corrected data in accordance with the exhaust system temperature (overheated condition) and storing the same in the memory is repeated, thus setting and correcting a range of air-fuel ratios at which the exhaust purifying device of the associated engine becomes high in temperature to thereby reduce the variations in performance caused by different engines, minimizing exhaust emissions and deterioration in the fuel consumption and positively preventing the exhaust gas temperature from becoming excessively high.

DESCRIPTION OF THE PREFERRED EMBODIMENTS

The present invention will now be described in greater detail with reference to the illustrated embodiments.

Figure 1:
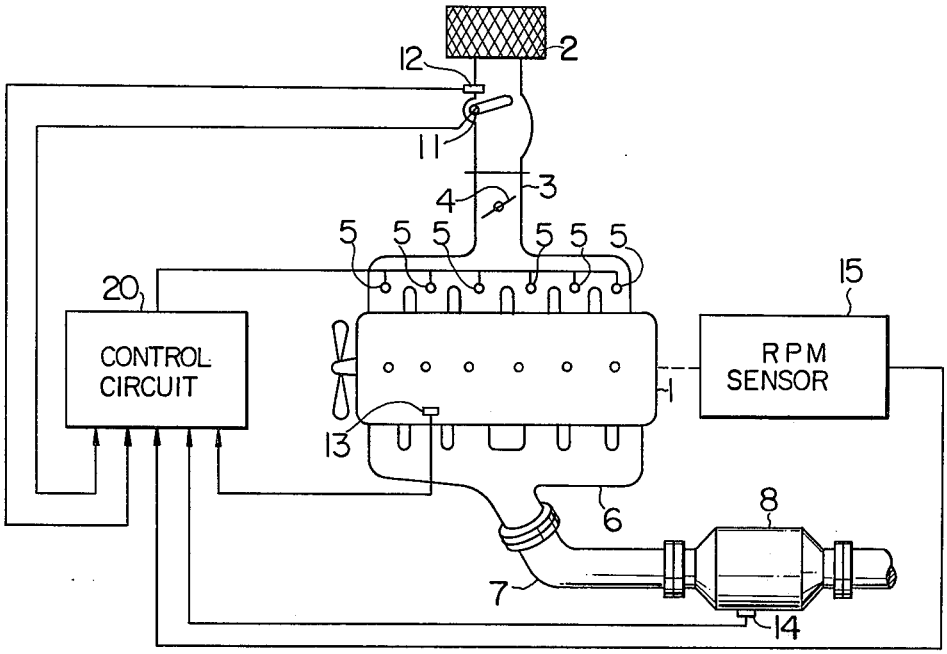
FIG. 1 is a schematic diagram showing the overall construction of an embodiment of the present invention.

Referring to FIG. 1 showing an embodiment of the invention, an engine 1 is a known type of four-cycle spark ignition engine adapted for installation on automotive vehicles and its combustion air is drawn by way of an air cleaner 2, an intake pipe 3 and a throttle valve 4. The fuel pressurized to a predetermined pressure is supplied to the engine 1 from the fuel system (not shown) by way of electromagnetic fuel injection valves 5 mounted for the respective cylinders. The exhaust gases resulting from the burning of the mixture are discharged to the atmosphere through an exhaust manifold 6, an exhaust pipe 7, an exhaust purifying catalytic converter 8, etc. Mounted in the intake pipe 3 are a potentiometer-type air-flow sensor 11 for sensing the quantity of air Q sucked into the engine 1 and generating an analog voltage corresponding to the sucked air quantity Q and a thermistor-type intake-air temperature sensor 12 for sensing the temperature of the air sucked into the engine 1 and generating an analog voltage (analog detection signal) corresponding to the temperature of the sucked air. Also mounted in the engine 1 is a thermistor-type water temperature sensor 13 for sensing the temperature of the cooling water and generating an analog voltage (analog detection signal) corresponding to the cooling water temperature, a thermistor-type temperature sensor 14 is mounted on the converter 8. A rotational speed or RPM sensor 15 senses the rotational speed of the crankshaft of the engine 1 to generate a pulse signal having a frequency corresponding to the rotational speed. The RPM sensor 15 may for example be comprised of the contact breaker of the ignition system so as to use the ignition pulse signal from the ignition coil primary terminal as a rotational speed signal. A control circuit 20 is provided to compute the desired fuel injection amount in accordance with the detection signals from the sensors 11 to 15, and the duration of opening time T of the electromagnetic fuel injection valves 5 is controlled so as to adjust the amount of fuel injected.

Figure 2:
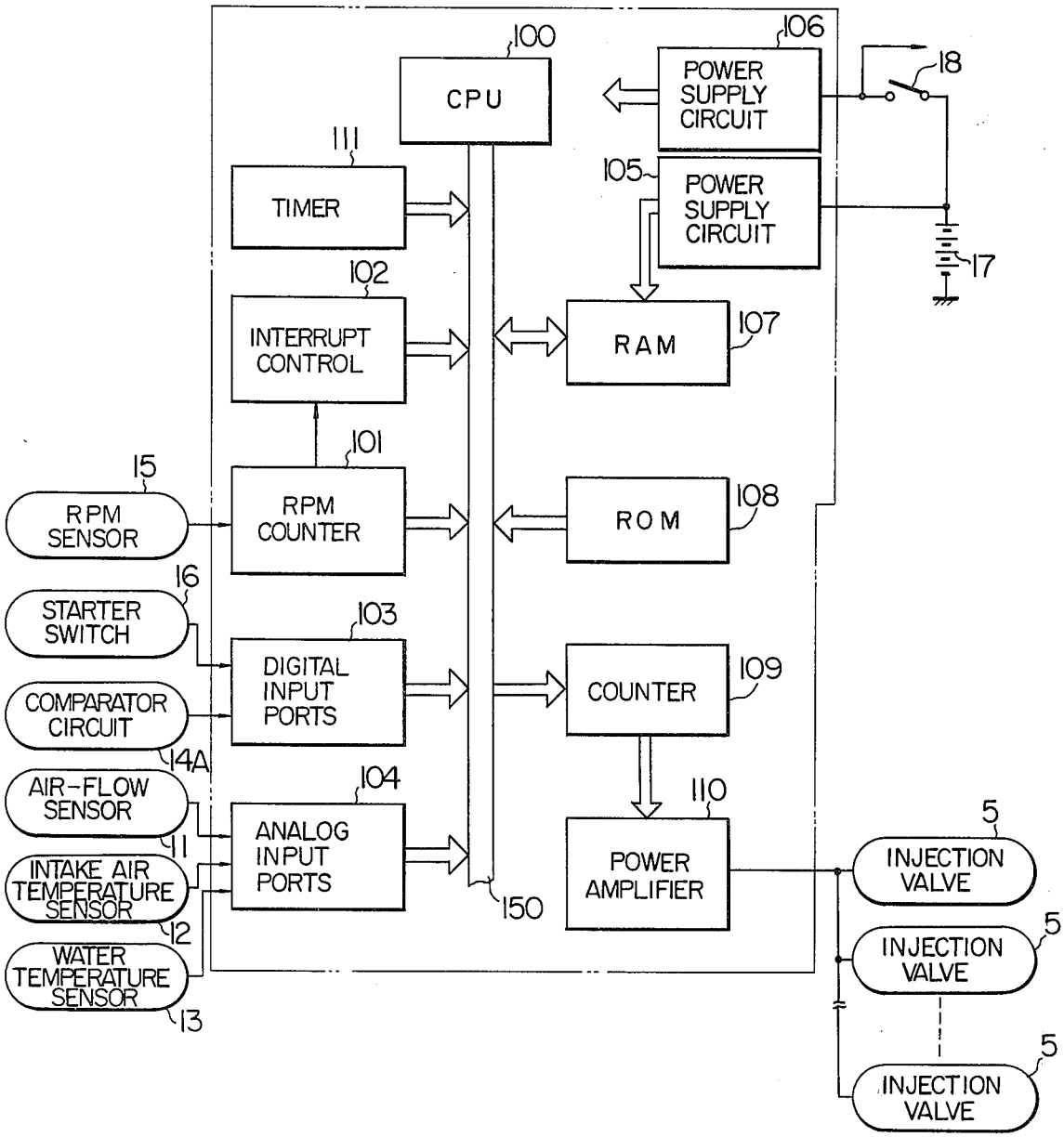
FIG. 2 is a block diagram of the control circuit shown in FIG. 1.

The control circuit 20 will now be described with reference to FIG. 2. In this embodiment, the control circuit 20 comprises a programmed digital computer. In FIG. 2, numeral 100 designates a microprocessor (CPU) for computing the amount of fuel injected. Numeral 101 designates an RPM counter for counting the number of engine revolutions in response to the signal from the RPM sensor 15. Also the RPM counter 101 applies an interrupt command signal to an interrupt control 102 in synchronism with the rotation of the engine 1 just after the completion of the counting of the engine RPM. When the signal is applied to the interrupt control 102, an interrupt request signal is applied to the microprocessor 100 from the interrupt control 102 through a common bus 150. Numeral 103 designates digital input ports for transferring to the microprocessor 100 digital signals including the output of a comparator circuit 14A responsive to the output signal of the exhaust temperature sensor 14 to effect comparison to determine whether the catalytic converter 8 is being overheated and the output signal of a starter switch 16 for turning on or off the operation of a starter which is not shown, i.e., the starter ON-state or OFF-state signal. Numeral 104 designates analog input ports comprising an analog multiplexer and an A/D converter and adapted to serve the function of subjecting the signals from the air-flow sensor 11, the intake-air temperature sensor 12 and the cooling water temperature sensor 13 and then successively reading them into the microprocessor 100. The output data from these units 101, 102, 103 and 104 are transferred to the microprocessor 100 through the common bus 150. Numeral 105 designates a power supply circuit for supplying power to an RAM 107 which will be described later. Numeral 17 designates a battery, and 18 a key switch. The power supply circuit 105 is connected to the battery 17 directly and not through the key switch 18. As a result, the power is always supplied to the RAM 107 irrespective of the key switch 18. Numeral 106 designates another power supply circuit connected to the battery 17 through the key switch 18. The power supply circuit 106 supplies power to the units except the RAM 107. The RAM 107 comprises a temporary read/write memory unit (RAM) which will be used temporarily when the computer is in operation and it is designed so that the power is always applied to it irrespective of the key switch 18 and the stored contents are prevented from being erased even if the key switch 18 is turned off and the operation of the engine is stopped. The RAM 107 is formed by a non-volatile memory. The value of compensation amount $K_2$ which will be mentioned later is also stored in the RAM 107. Numeral 108 designates a read-only memory (ROM) for storing a control program of the CPU 100, various constants, etc. Numeral 109 designates a fuel injection period controlling counter including a register and the counter 109 comprises a down counter whereby a digital signal computed by the microprocessor or CPU 100 and indicative of the valve opening period T of the electromagnetic fuel injection valves 5 or the fuel injection amount is converted to a pulse signal of a time width which determines the actual duration of opening of the electromagnetic fuel injection valves 5. Numeral 110 designates a power amplifier for actuating the electromagnetic fuel injection valves 5. Numeral 111 designates a timer for measuring and transferring the elapsed time to the CPU 100.

The RPM counter 101 is responsive to the output of the RPM sensor 15 to measure the engine rpm once for every engine revolution and upon completion of the measurement an interrupt command signal is applied to the interrupt control 102. In response to the applied signal, the interrupt control 102 generates an interrupt request signal and consequently the microprocessor 100 performs an interrupt handling routine which computes the amount of fuel to be injected.

Figure 3:
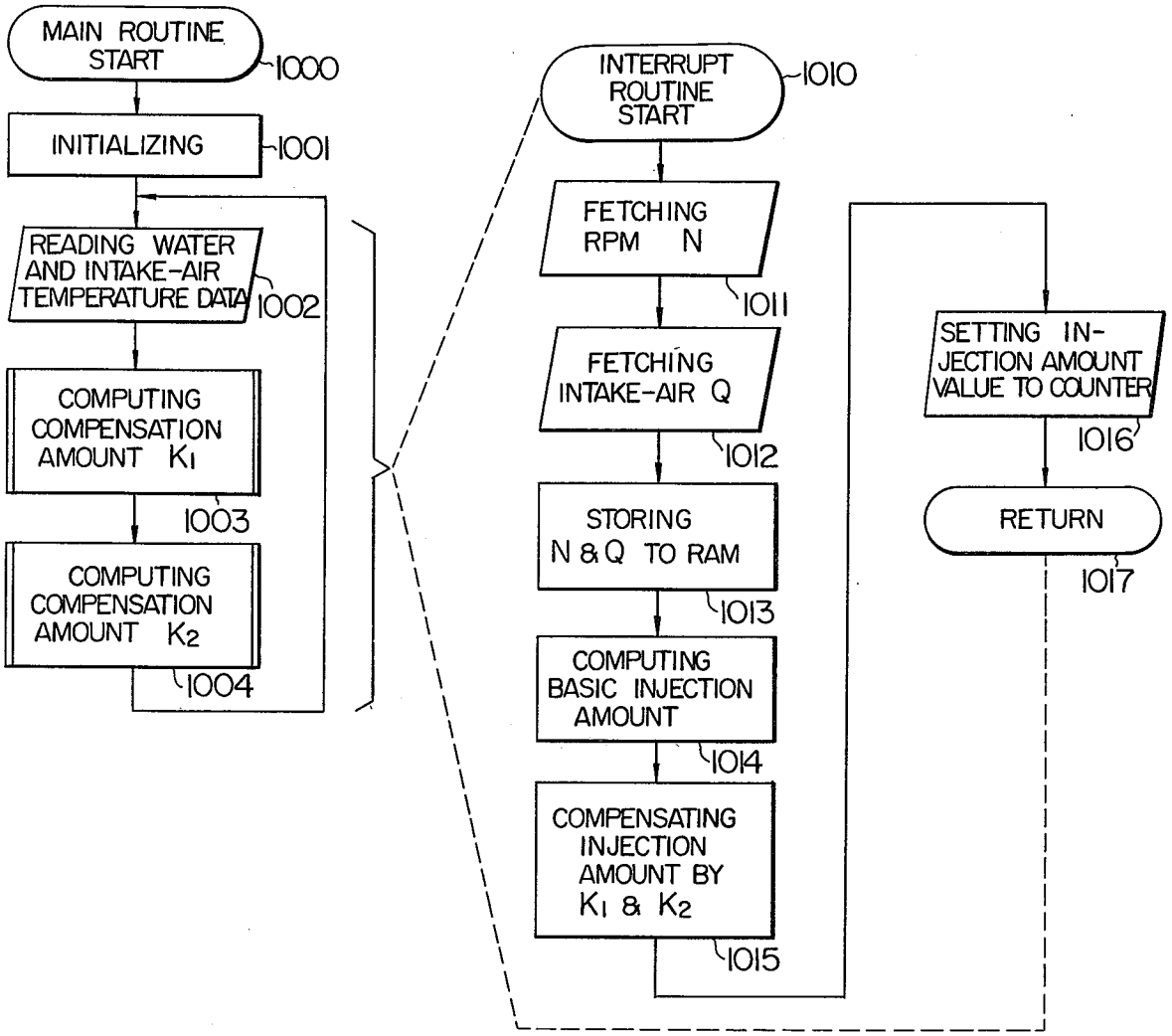
FIG. 3 is a simplified flow chart for the microprocessor shown in FIG. 2.

FIG. 3 shows a simplified flow chart for the microprocessor 100 and a large number of instructions for performing the flow chart are stored preliminarily in the ROM 108 by a known method. The function of the microprocessor 100 as well as the operation of the entire embodiment will now be described with reference to the flow chart. When the key switch 18 (FIG. 2) and the starter switch 16 are turned on so that the engine is started, a first step 1000 starts the computational operations of the main routine shown on the left side of FIG. 3 so that a step 1001 performs an initialization process and the individual circuits of the computer are reset to their initial states. The next step 1002 reads in the digital values corresponding to the cooling water temperature and the intake-air temperature from the analog input ports 104. A step 1003 computes a compensation amount $K_1$ from the digital values and the result is stored in the RAM 107. The compensation amount $K_1$ may be preliminarily stored in the ROM 108 so that it is read out in response to these values. A step 1004 introduces from the digital input ports 103 the output signal of the comparator circuit 14A responsive to the output of the exhaust temperature sensor 14 to determine whether there is an overheat condition or not, so that a compensation amount or data $K_2$ which will be described later is varied at intervals of a unit time $\Delta t$ as a function of the elapsed time measured by the timer 11 and the resulting compensation amount $K_2$ is stored in the RAM 107.

Figures 4, 5:
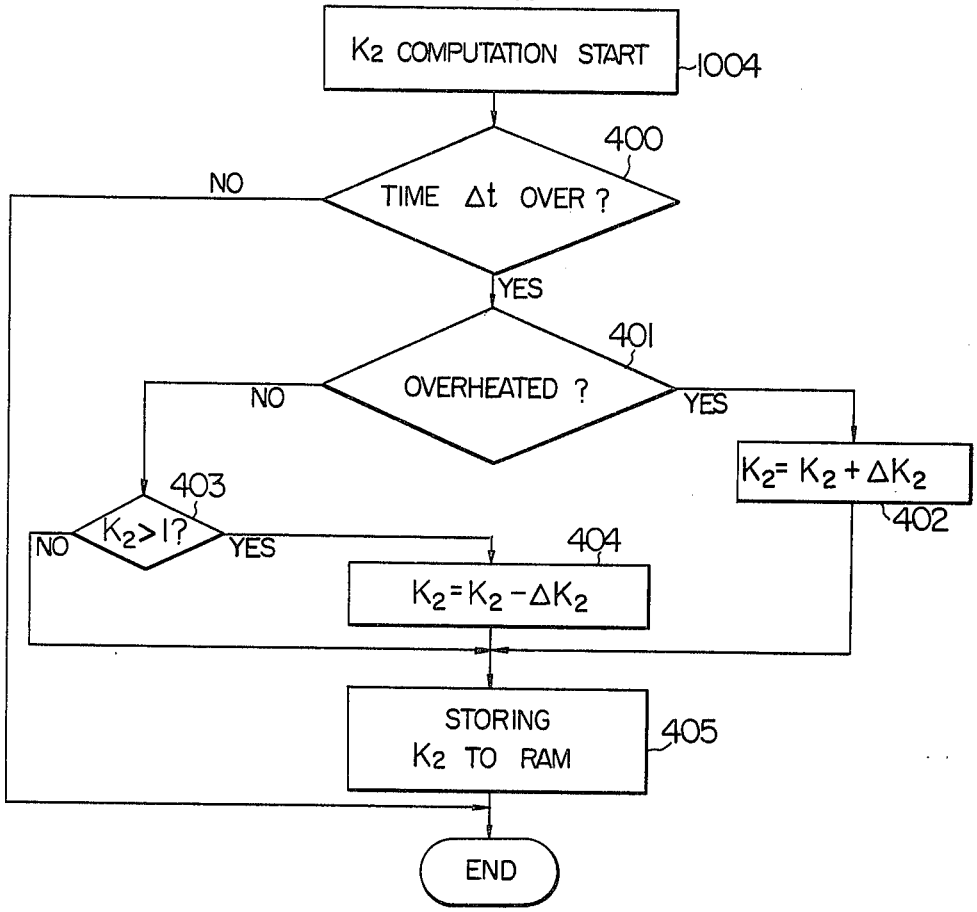
FIG. 4 is a detailed flow chart for the step 1004 shown in FIG. 3.
FIG. 5 is a map of compensation amount $K_2$ which is useful in explaining the operation of the invention.

FIG. 4 is a detailed flow chart for the process step 1004 for varying the compensation amount $K_2$. Firstly, a step 400 determines whether the unit time $\Delta t$ is over since the preceding computing cycle so that if it is not, the compensation amount $K_2$ is not corrected and the process step 1004 is completed. If the time has elapsed by $\Delta t$, the control is transferred to a step 401 which determines whether the output of the comparator circuit 14A responsive to the output signal of the exhaust temperature sensor 14 to compare and determine if the catalytic converter 8 is being overheated, is an overheat signal ("1") or non-overheat signal ("0"), that is, whether there is a condition of overheated converter. If it is or YES, the control is transferred to a step 402 so that of a large number of the values of the compensation amount $K_2$ which were obtained by the previous computing cycles and stored in the RAM 107 as shown by the map in FIG. 5, one corresponding to the then current engine condition, such as, $K_2=K_2(m, n)$ is read out and a correction amount $\Delta K_2$ of a predetermined value is added to the read $K_2$ to correct it (or it is corrected in a direction to enrich the air-fuel ratio). If the step 401 determines that the catalytic converter 8 is not being overheated, the control is transferred to a step 403 so that one of the stored values of the compensation amount $K_2$ in the RAM 107, such as, $K_2=K_2(m, n)$ corresponding to the current engine condition is read out to determine whether it is greater than 1. If the read $K_2$ is greater than 1, the control is transferred to a step 404 so that the correction amount $\Delta K_2$ is subtracted from the value of $K_2$ (or the compensation amount $K_2$ is corrected in a direction to cause the air-fuel ratio to approach the stoichiometric ratio). The compensation amount $K_2$ corrected by the step 402 or 404 is written in the associated one of the storage locations in the RAM 107 from which it was previously read out. If the step 403 determines that the read $K_2$ is equal to or smaller than 1, the value of $K_2$ is not corrected and the control is transferred to the step 405 which writes the non-corrected $K_2$ as such in the associated storage location of the RAM 107. When the described step 1004 of the main routine is completed, the control is again returned to the step 1002. In this way, the values of the compensation amount $K_2$ as determined in accordance with various values of the intake air amount Q and the engine rpm N are stored in the RAM 107 including a large number of addressable storage locations and a map is formed as shown in FIG. 5. Thus, $K_2(m, n)$ is indicative of the value of compensation amount $K_2$ on the map which corresponds to the m-th value of the intake air amount Q and the n-th value of the engine rpm N. In the present embodiment, the map in the RAM 107 is such that the values of the engine rpm N are divided in steps of 200 rpm and the values of the intake air amount Q are divided into 32 ranges for the engine operations from the idling to the full throttle operation.

The initialization process of the step 1001 performs the following additional operation. More specifically, when the vehicle is inspected or repaired, the battery may be removed. If the battery is removed, there is the danger of destroying and converting the values of the compensation amount $K_2$ stored in the RAM 107 to insignificant values. Thus, a constant having a predetermined pattern is usually preset in a specified storage location of the RAM 107 so as to determine whether the battery has been removed. When the program is started, whether the value of the constant has been destroyed or converted to a wrong value is determined so that if it is, it is considered that the battery has been removed. Thus all the values of the compensation amount $K_2$ are initialized to 1 and the constant of the predetermined pattern is established again. If the next starting of the program finds that the pattern constant has not been destroyed, the values of $K_2$ will not be initialized.

Usually, the steps 1002 to 1004 of the main routine are executed repeatedly in accordance with the control program stored in the ROM 108. When an interrupt request signal for initiating the computation of fuel injection amount is applied from the interrupt control 102 to the microprocessor 100, irrespective of whether any of the steps of the main routine is being executed, the microprocessor 100 immediately interrupts the execution of the step and the control is transferred to the interrupt handling routine of a step 1010. Thus, a step 1011 reads in the output signal of the RPM counter 101 which is indicative of the engine rpm N and the next step 1012 introduces from the analog input ports 104 the signal indicative of the amount of air flow Q (sucked air quantity). The next step 1013 stores these rpm N and the intake air amount Q in the associated storage locations of the RAM 107 so that these stored data may be used as parameters for the storage processing of the compensation amount $K_2$ in the computational operations of the main routine. The next step 1014 computes a basic fuel injection quantity (or the fuel injection time duration $\tau$ of the electromagnetic fuel injection valves 5) which is determined by the engine rpm N and the intake air amount Q. The expression for this computation is $\tau = F \times Q/N$ (where F is a constant). The next step 1015 reads out from the RAM 107 the fuel injection compensation amount $K_1$ computed by the main routine and one of the large number of values of the compensation amount $K_2$ corresponding to the then current engine condition and compensates the fuel injection quantity (or fuel injection time duration) which determines the air-fuel ratio. The computation expression of the injection time duration T is $T = \tau \times K_1 \times K_2$. The next step 1016 sets the data of the thus compensated fuel injection quantity T in the counter 109. The control is then transferred to a step 1017 from which the control is returned to the main routine. In this case, the control is returned to the process step of the main routine which was interrupted by the previous interruption. The function of the microprocessor 100 has been described briefly.

It will thus be seen from the foregoing that when the temperature of the catalytic converter 8 constituting an exhaust purifying device rises to a high value (overheat temperature) greater than a predetermined value, the compensation amount $K_2$ is corrected in a direction to increase it, that is, in the present embodiment the compensation amount $K_2$ is controlled in such a manner that the fuel injection quantity is increased and the air-fuel ratio is decreased (enriched). Thus the oxygen concentration of the exhaust gases is decreased and the reaction temperature of the catalytic converter 8 is decreased so as to prevent the overheat condition from continuing. On the contrary, in the normal condition where the temperature of the catalytic converter 8 is lower than the predetermined value, the compensation amount $K_2$ is corrected to approach 1 so that the air-fuel ratio is increased so as to approach the stoichiometric ratio and thus the air-fuel ratio is prevented from being unnecessarily decreased (enriched) as in the case of the prior art method, thereby preventing deterioration of both the exhaust gas characteristic and the fuel consumption.

While, in the embodiment described above, the map is prepared by using the intake air amount and the engine rpm as parameters indicative of the engine operating conditions for dividing and storing the values of compensation amount $K_2$ in the RAM 107 and arranging the parameter values in predetermined steps as shown in FIG. 5, other parameters, such as, the injection pulse width, intake negative pressure, throttle valve opening, etc., may also be used. Further, in addition to the applications in connection with the electronically controlled fuel injection, the invention may be applied for controlling the amount of fuel supply in the carburetor, the amount of air bypassing the carburetor or the amount of secondary air introduced into the exhaust purifying device so as to adjust the air-fuel ratio and thereby to control the concentration of oxygen in the exhaust gases. In the control of secondary air flow, however, if the exhaust purifying device is overheated, the air-fuel ratio in the purifying device should preferably be adjusted in a direction to become great (lean) as compared with the stoichiometric air-fuel ratio.

Further, while, in the above-described embodiment, the exhaust purifying device comprises the catalytic converter 8, it may for example be comprised of a thermal reactor.

It will thus be seen from the foregoing that the method of this invention employs an exhaust purifying device for purifying the exhaust gases from an engine and an exhaust temperature sensor for sensing the temperature in the vicinity of the exhaust purifying device, whereby the air-fuel ratio of the exhaust gases is controlled in accordance with the output signal of the exhaust temperature sensor so as to prevent overheating of the exhaust purifying device. Thus the method is characterized in that whether the exhaust purifying device is overheated determined in accordance with the output signal of the exhaust temperature sensor, that in accordance with the current engine operating conditions at the time of data processing corresponding one of a plurality of air-fuel ratio compensation data stored in the associated storage locations of a memory in correspondence with various engine operating conditions is read out and corrected by a predetermined amount in accordance with the result of the determination and the corrected new air-fuel ratio compensation data is rewritten in the associated storage location of the memory, and that the air-fuel ratio is adjusted in accordance with one of the air-fuel ratio compensation data stored in the memory corresponding to the then current engine operating conditions. Thus there are great advantages that the exhaust purifying device is prevented from being overheated, that the air-fuel ratio needs not be deviated unnecessarily, and that deterioration of the fuel consumption and the exhaust gas characteristic is prevented.

We claim:

1. A method of preventing overheating of an exhaust purifying device positioned in the exhaust system of an internal combustion engine comprising the steps of:

sensing the operating conditions of said internal combustion engine;

sensing the temperature of said exhaust purifying device;

comparing said sensed temperature with a predetermined value;

reading a storage value stored in an addressable storage location of a read/write memory, said one of an addressable storage location being addressed in correspondence with said sensed operating conditions;

correcting said storage value in increasing and decreasing directions in response to the result of said comparing step;

writing said corrected storage value in said one of an addressable storage location of said read/write memory; and controlling the oxygen concentration in the exhaust gas flowing into said exhaust purifying device in accordance with said corrected storage value.

2. A method according to claim 1, wherein said read/write memory is formed by a non-volatile memory.

* * * * *